US010227732B2

(12) United States Patent
van den Bruinhorst et al.

(10) Patent No.: US 10,227,732 B2
(45) Date of Patent: Mar. 12, 2019

(54) RAILWAY

(71) Applicants: Movares Nederland B.V., Utrecht (NL); Koninklijke Bam Groep N.V., Bunnik (NL)

(72) Inventors: Jacob van den Bruinhorst, Utrecht (NL); Jelte Annee Bos, Utrecht (NL); Jozef Aloysius Maria Jansen, Bunnik (NL)

(73) Assignees: MOVARES NEDERLAND B.V., Utrecht (NL); KONINKLIJKE BAM GROEP N.V., Bunnik (NL)

( * ) Notice: Subject to any disclaimer, the term of this patent is extended or adjusted under 35 U.S.C. 154(b) by 0 days.

(21) Appl. No.: 15/784,851

(22) Filed: Oct. 16, 2017

(65) Prior Publication Data

US 2018/0038050 A1 Feb. 8, 2018

Related U.S. Application Data

(63) Continuation of application No. PCT/NL2016/050257, filed on Apr. 13, 2016.

(30) Foreign Application Priority Data

Apr. 14, 2015 (NL) ..... 2014640

(51) Int. Cl.
*E01B 9/30* (2006.01)
*E01B 9/48* (2006.01)

(52) U.S. Cl.
CPC ..... *E01B 9/483* (2013.01); *E01B 9/30* (2013.01)

(58) Field of Classification Search
CPC . E01B 9/30; E01B 9/303; E01B 9/306; E01B 9/38; E01B 9/44; E01B 9/46; E01B 9/48; E01B 9/483; E01B 9/486
See application file for complete search history.

(56) References Cited

U.S. PATENT DOCUMENTS

| | | | | |
|---|---|---|---|---|
| 3,826,424 A * | 7/1974 | McClung | ..... | E01B 9/28 238/264 |
| 4,275,832 A * | 6/1981 | Kenyon | ..... | E01B 9/40 238/283 |
| 6,572,027 B1 * | 6/2003 | Pilesi | ..... | E01B 9/68 238/310 |
| 9,708,775 B2 * | 7/2017 | Bos | ..... | E01B 9/46 |

(Continued)

FOREIGN PATENT DOCUMENTS

| | | |
|---|---|---|
| EP | 2339068 | 6/2011 |
| GB | 2199875 | 7/1988 |

(Continued)

*Primary Examiner* — Jason C Smith
(74) *Attorney, Agent, or Firm* — Peacock Law P.C.; Janeen Vilven; Camille Martinez

(57) ABSTRACT

Railway comprising sleepers and rails supported thereby, wherein each sleeper has a holding piece anchored in or to the sleeper, and a clip or spring is connected to the holding piece and simultaneously presses on the rail to provide a downward holding force to the rail and maintain it on the sleeper. The holding piece and the clip or spring are supplemented with a mounting body and a mounting piece, which mounting body is placed over or adjacent to said holding piece, and which mounting body is arranged to cooperate with said mounting piece.

9 Claims, 5 Drawing Sheets

(56) References Cited

U.S. PATENT DOCUMENTS

| | | | | |
|---|---|---|---|---|
| 2004/0084548 | A1* | 5/2004 | Schwarzbich | E01B 9/40 238/310 |
| 2008/0179419 | A1* | 7/2008 | Vives Clavel | E01B 9/38 238/264 |
| 2009/0084864 | A1* | 4/2009 | Bosterling | E01B 9/483 238/349 |
| 2010/0301126 | A1* | 12/2010 | Meyer | E01B 9/483 238/303 |
| 2013/0105590 | A1* | 5/2013 | Buda | E01B 9/303 238/351 |
| 2013/0153671 | A1* | 6/2013 | Bosterling | E01B 9/303 238/349 |
| 2015/0136865 | A1* | 5/2015 | Walter | E01B 2/003 238/345 |
| 2017/0321382 | A1* | 11/2017 | Olbrich | E01B 9/42 |
| 2018/0023257 | A1* | 1/2018 | Constantine | E01B 9/40 238/304 |

FOREIGN PATENT DOCUMENTS

| | | |
|---|---|---|
| WO | 95/20070 | 7/1995 |
| WO | 2009/004274 | 1/2009 |
| WO | 2016/167653 | 10/2016 |

* cited by examiner

RAILWAY

CROSS-REFERENCE TO RELATED APPLICATIONS

This application is a continuation application of Patent Cooperation Treaty Application No. PCT/NL2016/050257, filed on Apr. 13, 2016, which claims priority to Netherlands Patent Application No. 2014640, filed on Apr. 14, 2015, and the specifications and claims thereof are incorporated herein by reference.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable.

INCORPORATION BY REFERENCE OF MATERIAL SUBMITTED ON A COMPACT DISC

Not Applicable.

STATEMENT REGARDING PRIOR DISCLOSURES BY THE INVENTOR OR A JOINT INVENTOR

Not Applicable.

COPYRIGHTED MATERIAL

Not Applicable.

BACKGROUND OF THE INVENTION

Field of the Invention (Technical Field)

The present invention relates to a railway comprising sleepers and rails supported by said sleepers, wherein each sleeper is provided with a holding piece immovably anchored in or to the sleeper, and wherein a clip or spring is connected to the holding piece and simultaneously presses on the rail to provide a downward holding force to said rail and maintain it on the sleeper.

Description of Related Art Including Information Disclosed Under 37 C.F.R. 1.97 and 1.98

Several railway embodiments including the type of railway to which the invention relates are known from the handbook "Railbevestigingen" by the author Jan Roos, of January 2015 pages 286-292; ISBN/EAN 9789081787123.

The railway of the invention essentially relates to the type wherein a holding piece for the rails is immovably anchored in or to the sleeper. Usually then the sideways positioning of the rails is secured by either the holding piece which is immovably anchored in or to the sleeper, or by the construction of the clip or spring that is connected to the holding piece and presses the rail on the sleeper. A clear example of the latter embodiment is known from GB-A-2 199 875. The invention therefore relates to a railway that differentiates from the type that is for instance known from EP-A-2 339 068, and which is embodied with a removable "Winkelführungsplatte" for sideways positioning of the rails, and wherein the connection of the rails with the sleeper is a bolt that is also removable. This second type of railway is therefore distant from the invention and not provided with any part that is immovably anchored in or to the sleeper. The invention is therefore restricted to the first type of railway wherein the holding piece for the rails is immovably anchored in or to the sleeper.

It is a known problem of existing railways of any type that the support of the railway may vary depending on the deterioration of the ballast underneath the sleepers, particularly although not exclusively shortly after establishing a new railway. The problem is however also existent with older railways, and is connected with the deterioration of the supporting structure of the sleepers which may be different for different parts of the railway. The problem is particularly prominent when a first railway part rests on ballast, and a second adjacent railway part rests on a more fixed structure such as concrete, as may be the case at a railway crossing. Further it is known that over time the ballast may become more dense, and this deterioration is promoted by the regularly passing trains, which in turn will result in accelerated densification of the ballast. The ballast getting more dense may eventually even result in that the sleepers will no longer be supported by ballast, but will be hanging from the rail. This is very detrimental to passenger comfort, and may result in rail failure.

It is known that the above pictured problem is resolved by more or less intensive maintenance of the ballast, in the form of repeated deliberate tamping of the ballast and bringing in additional ballast material. This is however at the expense of high costs, whilst practice learns that the results are poor.

Another known solution is the method of stone blowing in which relatively fine ballast material is blown under the sleeper during it being lifted. This known method is relatively effective but it spoils the composition of the ballast underneath the sleepers and it is not a permanent solution.

Another solution to the said problem is known from EP-A-2 339 068 for the second type of railway that has no parts that are immovably anchored in or to the sleepers. In this solution the distance or elevation of the rails with respect to the sleepers can be tailored to the requirements. However, in the prior art of the first type of railway to which the invention relates it is not possible to make the distance or elevation of the rails with respect to the sleepers variable.

It is an object of the invention to address the above mentioned problems and to cut maintenance and maintenance-costs, while improving passenger comfort and reducing the risk of rail failure for this first type of railway wherein the holding pieces for the rail are immovably anchored in or to the sleepers.

The applicants remark that WO95/20070 discloses a railway according to the preamble wherein the holding piece and the clip or spring for providing a downward holding force to said rail and maintain it on the sleeper are supplemented with a mounting body and a mounting piece, which mounting body is placed over or adjacent to said holding piece and is arranged to cooperate with said mounting piece, wherein said mounting piece is equipped with a first mounting part which is dimensioned for connection to the holding piece that is anchored in or to the sleeper, and wherein the mounting piece is further equipped with a second mounting part equipped with screw thread that extends above the mounting body, wherein the clip or spring is mounted directly or indirectly on top of the mounting body with its opposite extremities positioned on the rail and (indirectly)

on the sleeper respectively, and wherein the second mounting part of the mounting piece extends above the spring or clip, and wherein a nut is provided on the screw thread to fix the clip or spring in position. Preferably an intermediate mounting plate is positioned between the nut and the clip or spring.

According to WO-A-2009/004274 a rail fastening assembly is known with a holding piece, a mounting body and mounting piece, whereby the holding piece is provided with wings and the mounting body is dimensioned to fit under said wings, at least partly anchored in a sleeper.

BRIEF SUMMARY OF THE INVENTION

The railway of the invention is embodied with the features of one or more of the appended claims.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings.

DETAILED DESCRIPTION OF THE INVENTION

Figure 1:
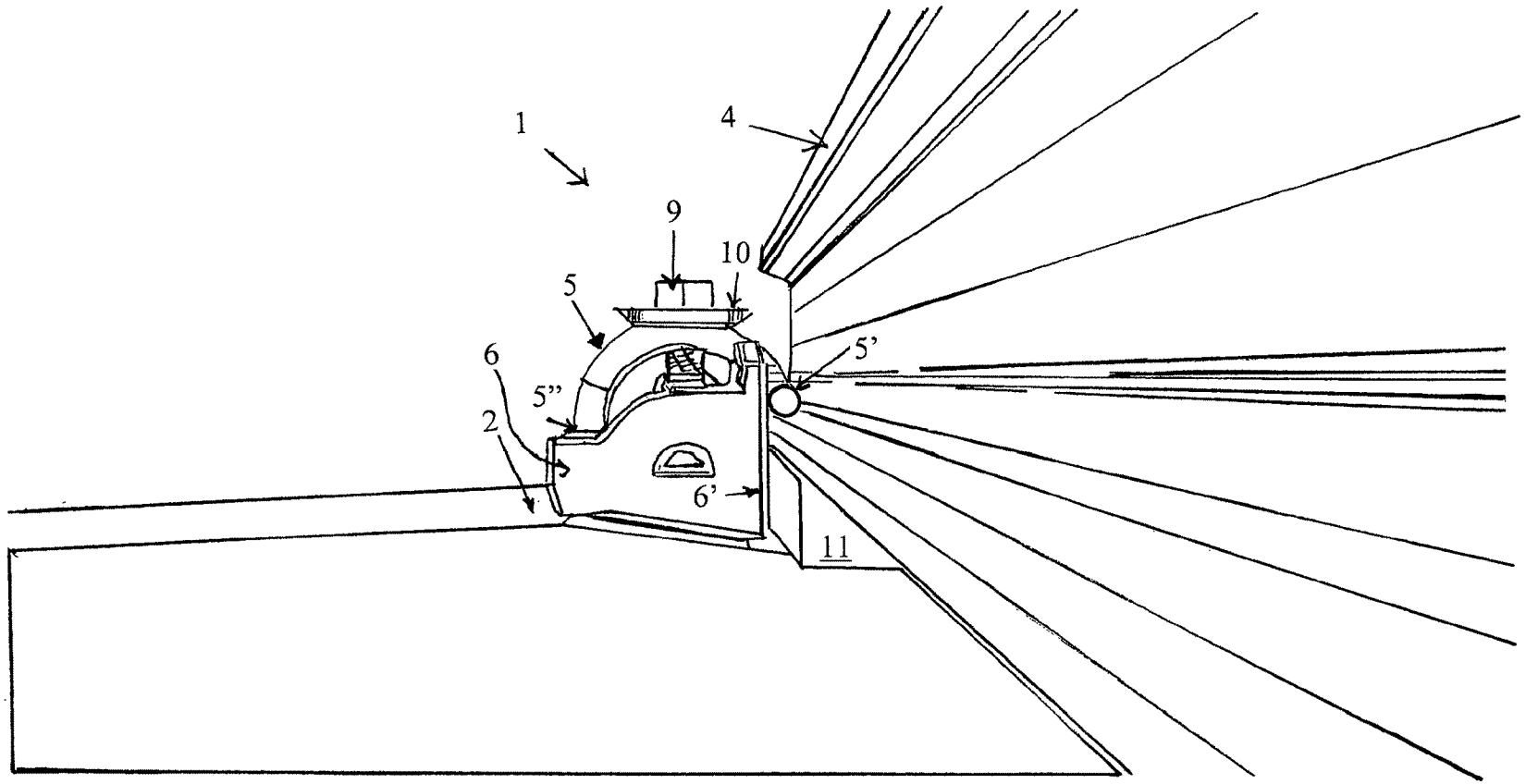
FIG. 1 shows a side view of a first embodiment of a railway according to the invention.

There are several embodiments possible for the railway of the invention.

In one embodiment the holding piece anchored in or to the sleeper is provided with wings and the mounting body is dimensioned to fit underneath said wings with at least part of the mounting piece snugly fitting between the mounting body and the holding piece anchored in or to the sleeper. In this embodiment it is preferred that the clip or spring is mounted directly or indirectly on top of the wings of the holding piece that is anchored in or to the sleeper, wherein the clip or spring has its opposite extremities positioned on the rail and on said wings of the holding piece respectively.

In another embodiment wherein the mounting body is provided with a slit to receive the mounting piece and enable the mounting piece to connect to the holding piece anchored in or to the sleeper as known from WO-A-2009/004274, the invention provides that the mounting piece is embodied as a hook with a rod portion for connection with the holding piece anchored in or to the sleeper, and that a screw thread portion extends at substantially right angles with respect to the rod portion. In that situation it is preferred that the clip or spring is mounted directly or indirectly on top of the mounting body with its opposite extremities positioned on the rail and the mounting body respectively.

The construction of the invention has several benefits.

A first benefit of the invention is that the combination of features of the main claim makes it possible to set a variable height or distance of the rails with respect to the sleepers. A second benefit relates to the feature that it is preferred that the nut is actuated so as to elastically deform the clip or spring. The elastic deformation of the clip or spring secures that an accurate holding force can be applied and maintained to keep the rail in position on the sleeper. A third benefit is that the construction of the invention enables that the mounting body can effectively also be provided with an upstanding side adjacent to the rail to delimit displacement of the rail and accommodate that the rail can easily be mounted at a variable distance or height with respect to the sleeper.

It is further preferable that the mounting body is provided with an upstanding side which has grooves to cooperate with corresponding grooves or protrusions of a pad or pads positioned between the rails and the sleeper to restrict movement of the pads in the longitudinal direction of the rails. The pads can be applied for instance in the form of wedges as taught by EP-A-2 339 068 to maintain the rails on the sleepers at a desired elevation or distance with respect to such sleepers.

The invention will hereinafter be further elucidated with reference to the drawing of exemplary embodiments of a railway according to the invention that is not limiting as to the appended claims.

Whenever in the figures the same reference numerals are applied, these numerals refer to the same parts.

Figure 2:
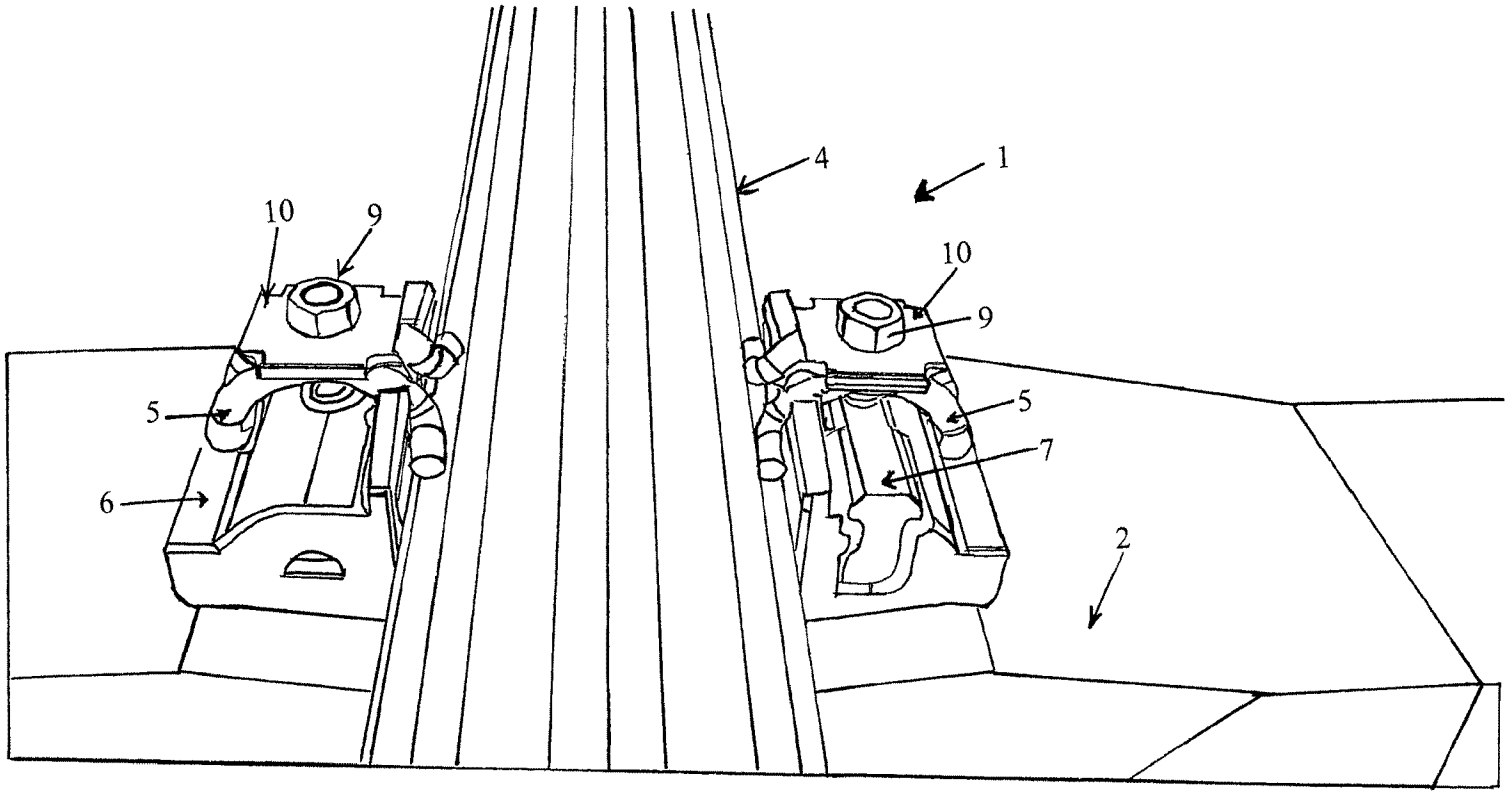
FIG. 2 shows a top view of the first embodiment shown in FIG. 1.
Figure 3:
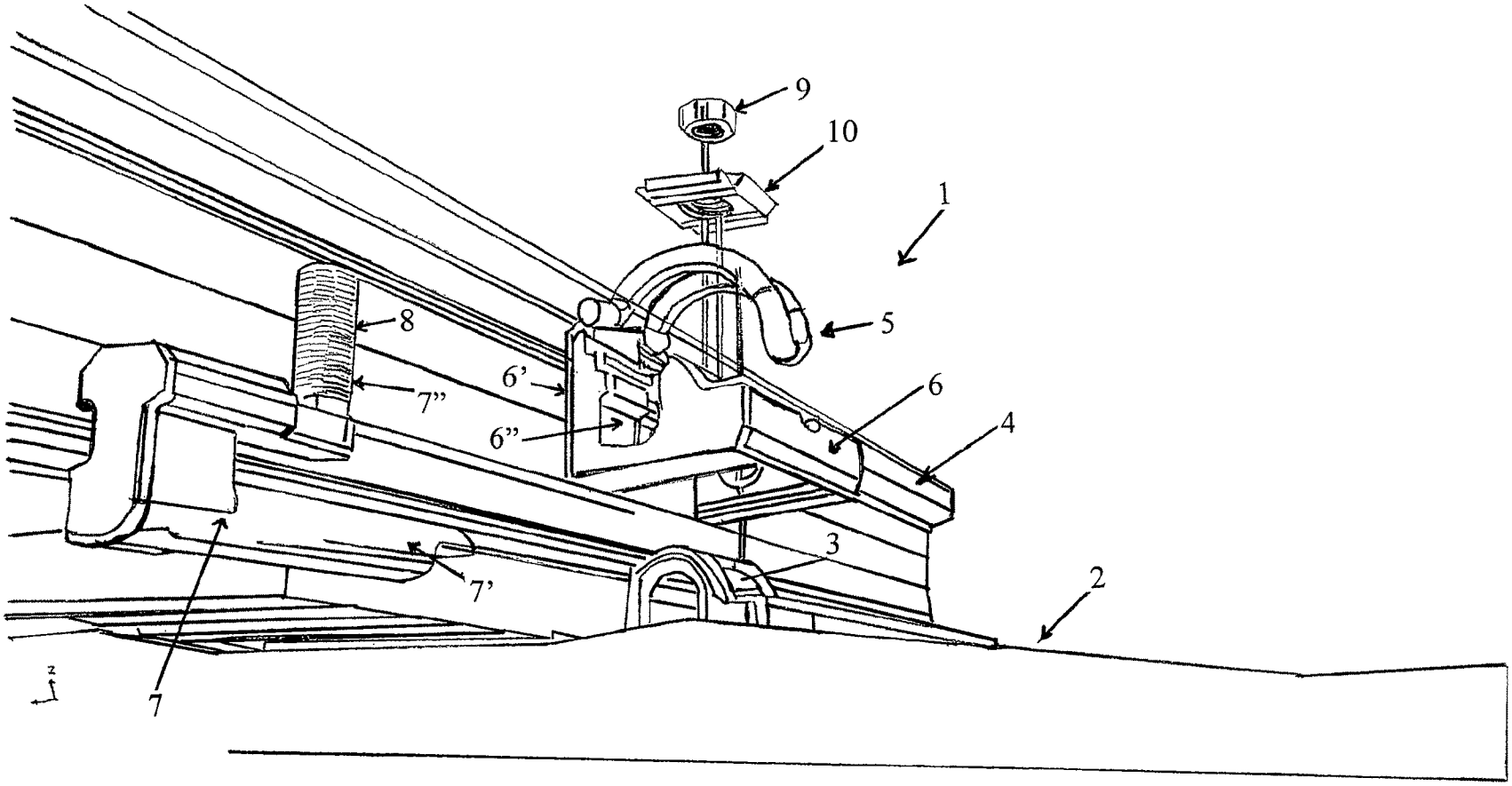
FIG. 3 shows an exploded view of the first embodiment shown in FIG. 1.

As the skilled person knows a railway comprises sleepers 2 and rails 4 supported by said sleepers 2; see FIGS. 1-3. In the following reference will be made to said figures showing a railway 1 of the type in which each sleeper 2 (see in particular FIG. 3) is provided with a holding piece 3 anchored in or to the sleeper 2, and wherein (as will be explained hereinafter) a clip or spring 5 is (indirectly) connected to the holding piece 3 and simultaneously presses on the rail 4 to provide a downward holding force to said rail 4 and maintain it on the sleeper 2.

In all embodiments of the invention, and in particular in the first embodiment now discussed with reference to FIGS. 1-3, the holding piece 3 and the clip or spring 5 which as such are known from the prior art, are supplemented with new components, in particular a mounting body 6 and a mounting piece 7. The mounting body 6 is placed over or adjacent to said holding piece 3 as depicted in FIGS. 1 and 2 (because of which the holding piece 3 is no longer visible in these FIGS. 1 and 2), and said mounting body 6 is arranged to cooperate with said mounting piece 3. For this purpose said mounting piece 7 is equipped with a first mounting part 7' which is dimensioned for connection to the holding piece 3 (see again FIG. 3), wherein the mounting piece 7 is further equipped with a second mounting part 7" which is in this embodiment at substantially right angles with said first mounting part 7' which is equipped with screw thread 8 that extends above the mounting body 6 which can be best seen in FIG. 1. The functionality hereof will become apparent from the following disclosure.

In this embodiment of FIGS. 1-3 the clip or spring 5 is mounted directly or indirectly on top of the mounting body 6 with the opposite extremities 5', 5" of the clip or spring 5 positioned on the rail 4 and (indirectly via the mounting body 6) on the sleeper 2 respectively. This can be best seen in FIGS. 1 and 2. As FIG. 1 shows the second mounting part 7" of the mounting piece 7 extends above the clip or spring 5, and a nut 9 is provided on the screw thread 8 that is provided on the second mounting part 7" to fix the clip or spring 5 in position. It is also shown that an intermediate mounting plate 10 is positioned between the nut 9 and the clip or spring 5. Preferably the nut 9 is actuated so as to elastically deform the clip or spring 5.

Particularly FIG. 1 and FIG. 2 show the preferential arrangement that the mounting body 6 is provided with an upstanding side 6' adjacent to the rail 4 to delimit displacement of the rail 4 and accommodate that the rail 4 can be mounted at a variable distance or height with respect to the sleeper 2 when one or more pads 11 are provided between the rail 4 and the sleeper 2. The pads 11 can be of rectangular shape or be formed as cooperating wedges as disclosed in EP 2 339 068.

Preferably the upstanding side 6' of the mounting body 6 is further provided with grooves (not shown) to cooperate with corresponding grooves or protrusions of a pad or pads 11 positioned between the rails 4 and the sleeper 2 to restrict movement of those pads 11 in the longitudinal direction of the rails 4. The way how this can be implemented is entirely clear to the skilled person so that a further elucidation with reference to the drawing can be dispensed with.

Returning now to FIG. 3 it is shown that the mounting body 6 is provided with a slit 6" to receive the mounting piece 7 and to enable that the mounting piece 7 can be connected to the holding piece 3 anchored in or to the sleeper 2. As this FIG. 3 shows in this embodiment the mounting piece 7 is embodied as a hook with a rod portion 7' for connection with the holding piece 3 that is anchored in or to the sleeper 2, and that the screw thread portion 8 extends at substantially right angles with respect to said rod portion 7'. Further the clip or spring 5 is mounted directly or indirectly on top of the mounting body 6 with its opposite extremities 5', 5" positioned on the rail 4 and the mounting body 6 respectively, as is best seen in FIGS. 1 and 2.

Figure 4:
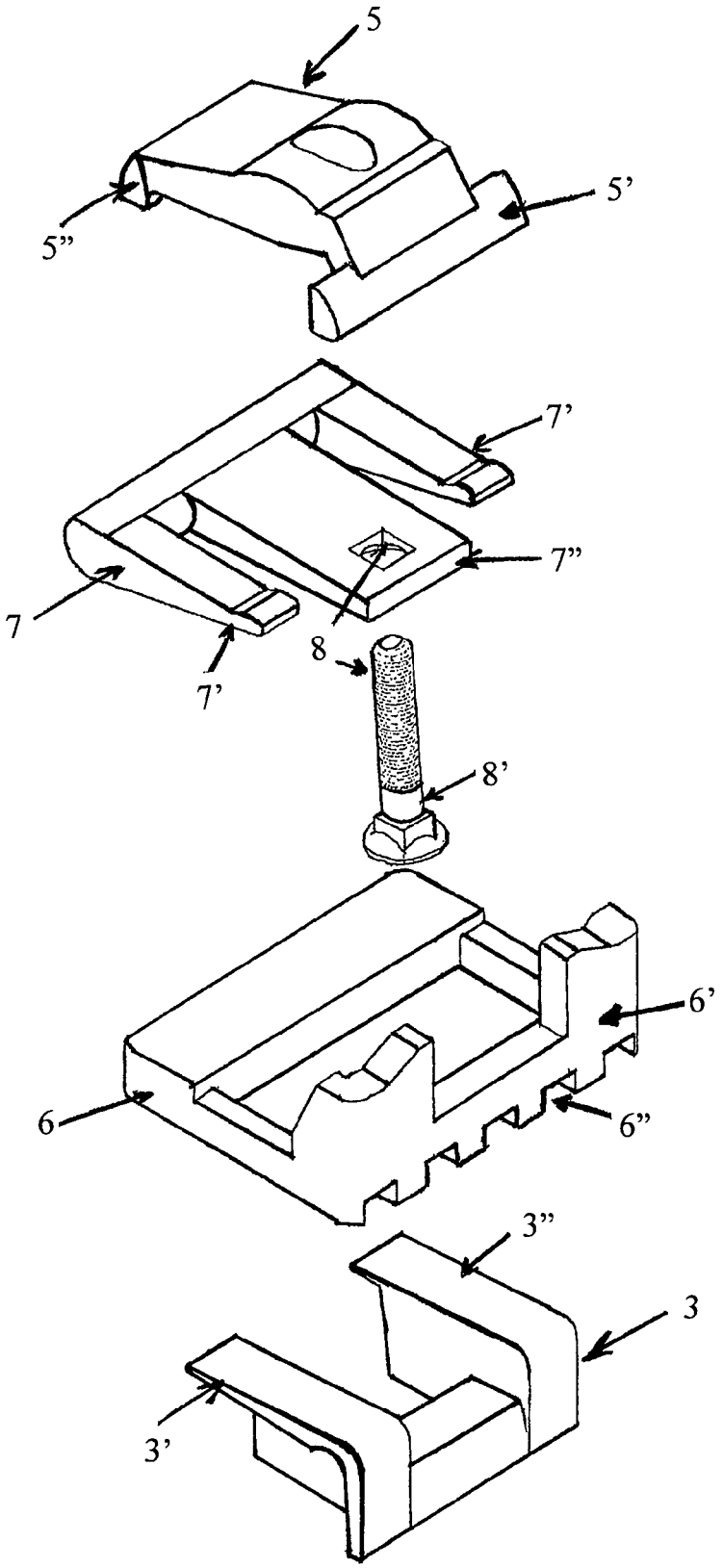
FIG. 4 shows an exploded view of the constituent elements of a second embodiment of the invention.
Figure 5:
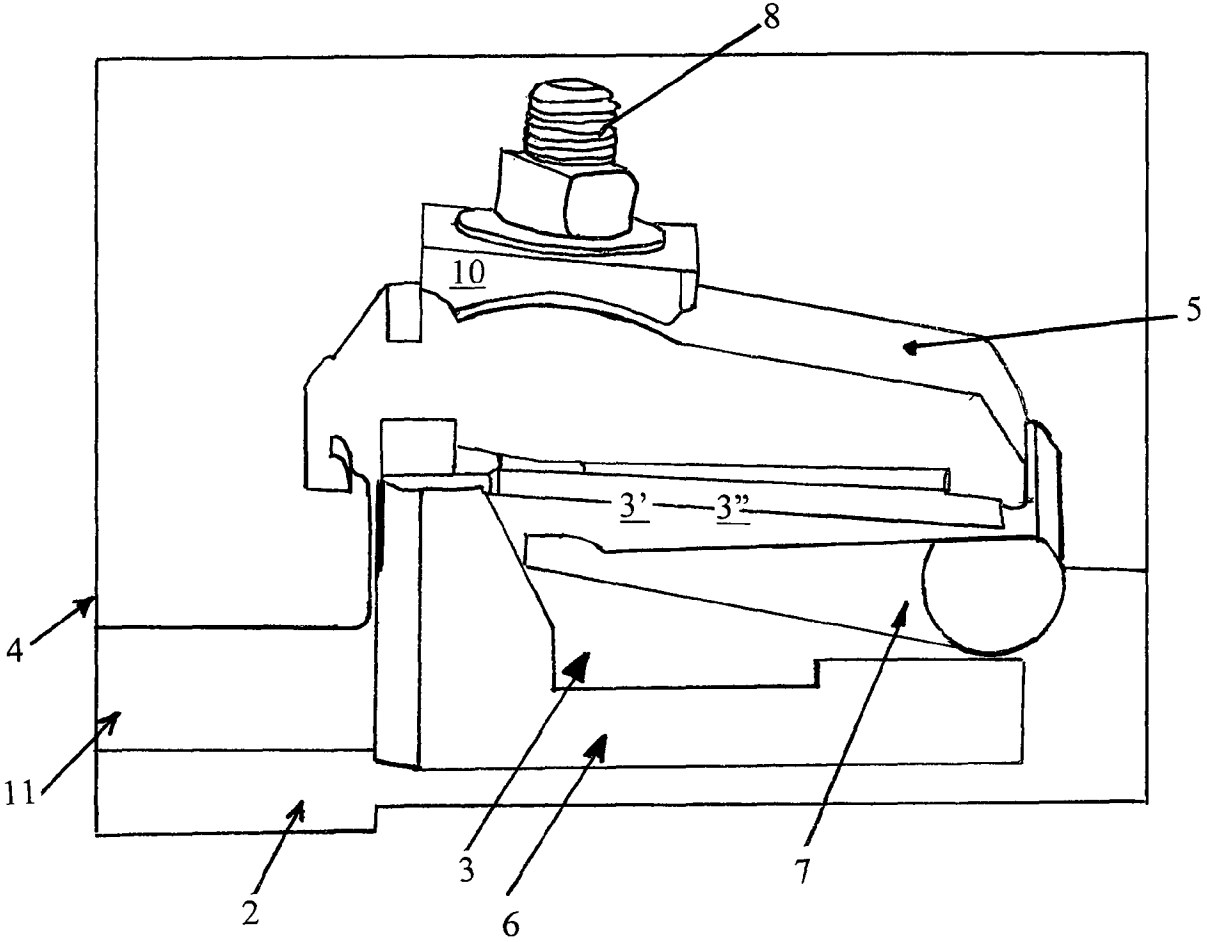
FIG. 5 an assembled view of the second embodiment according to FIG. 4.

An entirely different embodiment in which the principles of the invention are applied is shown in FIGS. 4 and 5.

FIG. 4 shows an exploded view of the elements that are used to anchor the rails 4 of a railway to its sleepers 2 (as shown in FIG. 5), using a clip or spring 5 that is connected to a holding piece 3 which is fixed to a sleeper 2 and which provides a downward holding force to the rail 4 and maintain said rail 4 on the sleeper 2.

Like the first embodiment, this second embodiment also supplements and completes a known holding piece 3 that is fixedly mounted to a sleeper (depicted with reference 2 in FIG. 5) and a clip or spring 5 that will be connected to said holding piece 3 for holding a rail 4 on the sleeper 2, with a mounting body 6 and a mounting piece 7. The mounting body 6 is placed over or adjacent to said holding piece 3, and is arranged to cooperate with said mounting piece 7 wherein said mounting piece 7 is equipped with a first mounting part 7' which is dimensioned for connection to the holding piece 3. Actually the holding piece 3 is in this embodiment and for this purpose provided with wings 3', 3" and the mounting body 6 is dimensioned to fit underneath said wings 3', 3" with at least part(s) 7' of the mounting piece 7 snugly fitting between the mounting body 6 and the wings 3', 3" of the holding piece 3 anchored in or to the sleeper 2.

The mounting piece 7 is further equipped with a second mounting part 7" comprising a (releasable) screw 8' with screw thread 8 that in the mounted condition extends above the mounting body 6, so that when the clip or spring 5 is mounted directly or indirectly on top of the wings 3, 3' of the holding piece 3 anchored in or to the sleeper 2, the clip or spring 5 has its opposite extremities 5', 5" positioned on the rail 4 and on said wings 3', 3" of the holding piece 3 respectively. Accordingly the clip or spring 5 is thus mounted directly or indirectly on top of the mounting body 6 with its opposite extremities 5', 5" positioned on the rail 4 and (indirectly) on the sleeper 2. The screw 8' extending from and forming part of the second mounting part 7" of the mounting piece 7 extends further to above the clip or spring 5, and as is shown in FIG. 5 is provided with a nut 9 on the screw thread 8 to fix the clip or spring 5 in position. FIG. 5 also shows that an intermediate mounting plate 10 is positioned between the nut 9 and the clip or spring 5. The nut 9 is preferably actuated so as to elastically deform the clip or spring 5.

Turning back to FIG. 4 it is shown that the mounting body 6 is provided with an upstanding side 6' which is intended to be adjacent to the rail 4 (see FIG. 5) to delimit displacement of the rail 4 and accommodate that the rail 4 can be mounted at a variable distance with respect to the sleeper 2.

FIG. 4 further clearly shows that the mounting body 6 is provided with an upstanding side 6' which has grooves 6" to cooperate with corresponding grooves or protrusions of a pad or pads 11 positioned between the rails 4 and the sleeper 2 to restrict movement of the pads 11 in the longitudinal direction of the rails 4.

Although the invention has been discussed in the foregoing with reference to exemplary embodiments of the railway of the invention, the invention is not restricted to these particular embodiments which can be varied in many ways without departing from the gist of the invention. The discussed exemplary embodiments shall therefore not be used to construe the appended claims strictly in accordance therewith. On the contrary the embodiments are merely intended to explain the wording of the appended claims without intent to limit the claims to these exemplary embodiments. The scope of protection of the invention shall therefore be construed in accordance with the appended claims only, wherein a possible ambiguity in the wording of the claims shall be resolved using these embodiments.

What is claimed is:

1. A railway comprising:

one or more sleepers; and one or more rails supported by the one or more sleepers, wherein each sleeper of the one or more sleepers is provided with a holding piece anchored in or to each sleeper, and wherein a clip or spring is connected to the holding piece and simultaneously presses on a rail to provide a downward holding force to the rail and maintain it on each sleeper, wherein the holding piece and the clip or spring are supplemented with a mounting body and a mounting piece, which mounting body is placed over or adjacent to the holding piece, and which mounting body is arranged to cooperate with the mounting piece wherein the mounting piece is equipped with a first mounting part which has dimensions that enable connection to the holding piece, and wherein the mounting piece is further equipped with a second mounting part equipped with a screw thread that extends above the mounting body, and the clip or spring is mounted directly or indirectly on top of the mounting body with its opposite extremities positioned on the rail and indirectly on each sleeper respectively, and wherein the second mounting part of the mounting piece extends above the clip or spring, and a nut is provided on the screw thread to fix the clip or spring in position, wherein the mounting body is provided with a slit to receive the mounting piece and enable the mounting piece to connect to the holding piece anchored in or to each sleeper, and the mounting piece is a hook with a rod portion for connection with the holding piece anchored in or to each sleeper, and a screw thread portion extending at substantially right angles with respect to the rod portion of the mounting piece.

2. The railway according to claim 1, wherein the holding piece is provided with wings and the mounting body is dimensioned to fit underneath the wings with at least part of the mounting piece snugly fitting between the mounting body and the holding piece anchored in or to each sleeper.

3. The railway according to claim 2, wherein the clip or spring is mounted directly or indirectly on top of the wings of the holding piece anchored in or to each sleeper, which clip or spring has its opposite extremities positioned on the rail and on the wings of the holding piece respectively.

4. The railway according to claim 1, wherein the second mounting part is at substantially right angles with the first mounting part.

5. The railway according to claim 1, wherein an intermediate mounting plate is positioned between the nut and the clip or spring.

6. The railway according to claim 1, wherein the nut is actuated so as to elastically deform the clip or spring.

7. The railway according to claim 1, wherein the mounting body is provided with an upstanding side adjacent to the rail to delimit displacement of the rail and accommodate that the rail can be mounted at a variable distance with respect to each sleeper.

8. The railway according to claim 1, wherein the mounting body is provided with an upstanding side which has grooves to cooperate with corresponding grooves or protrusions of a pad or pads positioned between the rails and each sleeper to restrict movement of the pads in the longitudinal direction of the rails.

9. The railway according to claim 1, wherein the clip or spring is mounted directly or indirectly on top of the mounting body with its opposite extremities positioned on the rail and the mounting body respectively.

* * * * *